United States Patent [19]

Winsel et al.

[11] Patent Number: 4,790,915

[45] Date of Patent: Dec. 13, 1988

[54] PROCESS FOR THE ELECTROLYSIS OF ALKALI METAL CHLORIDE SOLUTIONS

[75] Inventors: August Winsel; Rudolf Staab; Nikolaj Medić, all of Kelkheim, Fed. Rep. of Germany

[73] Assignee: Hoechst Aktiengesellschaft, Fed. Rep. of Germany

[21] Appl. No.: 2,142

[22] Filed: Jan. 12, 1987

[30] Foreign Application Priority Data

Jan. 14, 1986 [DE] Fed. Rep. of Germany ..... 3600759

[51] Int. Cl.[4] ..... C25B 1/00

[52] U.S. Cl. ..... 204/98; 204/128; 204/129

[58] Field of Search ..... 204/128, 98, 129

[56] References Cited

U.S. PATENT DOCUMENTS 4,488,947 1/1986 Miles ..... 204/98
4,563,261 12/1984 Staab et al. ..... 204/290 R

FOREIGN PATENT DOCUMENTS 3332566 3/1985 Fed. Rep. of Germany .
3342969 6/1985 Fed. Rep. of Germany .
0076997 7/1978 Japan ..... 204/98
0028296 3/1979 Japan ..... 204/98

*Primary Examiner*—John F. Niebling
*Assistant Examiner*—Kathryn Gorgos
*Attorney, Agent, or Firm*—Connolly and Hutz

[57] ABSTRACT

A process is described for electrolyzing aqueous alkali metal chloride solutions in a membrane cell which contains an anode chamber with the anode and a cathode chamber with the cathode, the two chambers being separated from one another by a cation exchanger membrane. The cathode is porous and foil-like. The cathode and cation exchanger membrane form the actual cathode chamber filled with catholyte and the cathode and cell wall form a gas space. Water is fed into the cathode chamber and alkali metal hydroxide solution is withdrawn from it, hydrogen is withdrawn from the cathode chamber and gas space, and aqueous alkali metal chloride solution is fed into the anode chamber and gaseous chlorine, together with depleted alkali metal chloride solution, is withdrawn from it. A direct voltage which is at least the same as the decomposition voltage is applied to the cathode and anode. A higher pressure is established in the cathode chamber than in the gas space.

6 Claims, 1 Drawing Sheet

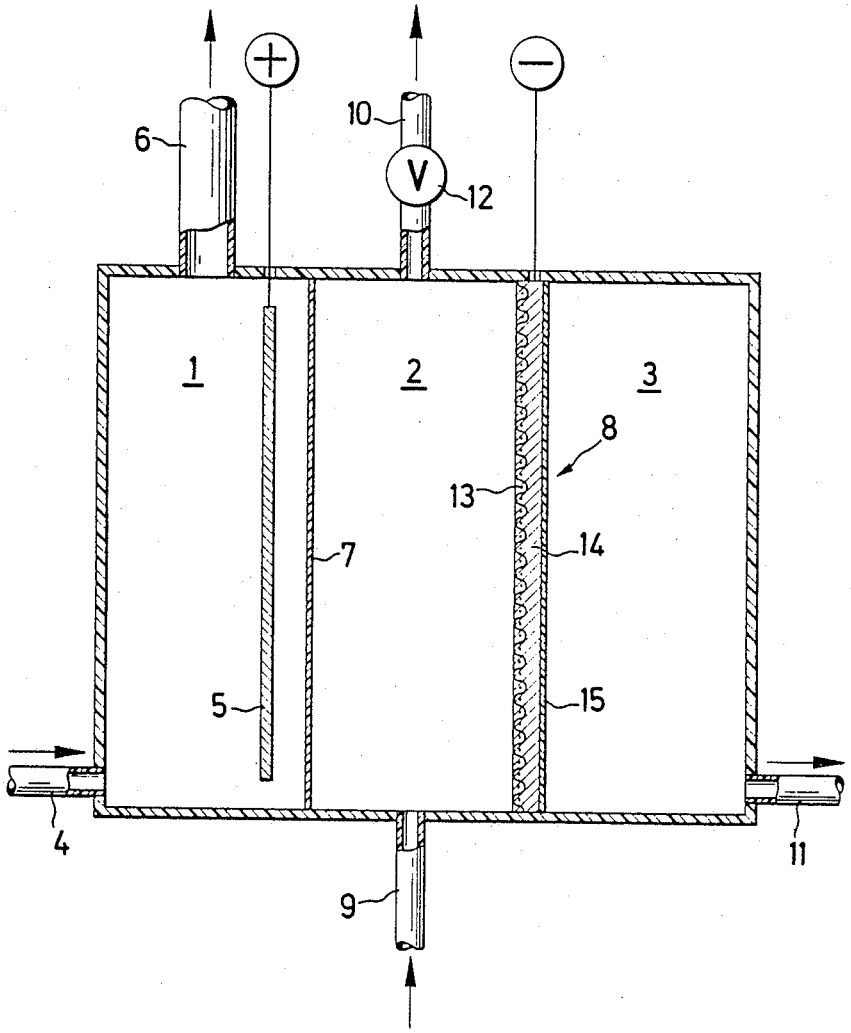
6
10
V
12
1
2
3
8
13
14
7
5
15
4
11
9

PROCESS FOR THE ELECTROLYSIS OF ALKALI METAL CHLORIDE SOLUTIONS

The invention relates to a process for the electrolysis of aqueous alkali metal chloride solutions by the membrane method in an electrolysis cell which is equipped with a porous cathode and in which the cell wall, together with the side of the cathode facing away from the cathode chamber, forms a closed space ("gas space").

About 50% of the world capacity for production of elemental chlorine is produced in electrolysis cells which operate by the amalgam process. The theoretical decomposition voltage of an alkali metal chloride in the mercury cell is about 3.15 to 3.20 volt. In contrast, a theoretical decomposition voltage of about 2.20 volt results if the alkali metal chloride electrolysis is carried out in a membrane cell with a cathode which generates hydrogen. The cell voltage can consequently theoretically be reduced by about 1 volt by introducing the membrane process, which is of considerable economic importance in times of increasing energy costs.

The membrane cell for the alkali metal chloride electrolysis usually consists of two electrolysis chambers each with an electrode which evolves a gas, the chambers being separated from one another by a cation exchanger membrane. Perforated materials, such as perforated sheet metals, rib meshes, networks and the like, are used in practice as electrode substrates. The perforated electrode structure is necessary so that the gas formed can be removed to the reverse side of the electrode as rapidly as possible and the resistance of the electrolyte is thus not increased unnecessarily by the formation of a gas cushion between the anode and cathode.

Because of the excess voltages for evolution of chlorine and hydrogen, catalyzed electrodes are used. On the anode side, titanium has proved to be a suitable electrode substrate, this being activated with noble metal oxides. Normal steel, stainless steel or nickel electrodes, which can be activated with noble metals or Raney nickel, are employed for cathodic evolution of hydrogen. Raney nickel is particularly suitable for catalyzing liberation of hydrogen, not least because of its extremely high internal surface area. On the other hand, however, it is difficult to apply Raney nickel to perforated electrode structures such as perforated sheet metals or rib meshes. Raney nickel electrodes have therefore previously been available only in the form of coated plates or coated sheet metals. When such sheet-like electrodes are incorporated into an electrolysis cell, however, there is the risk of the "gas bubble effect", that is to say a gas cushion forms between the cathode and cation exchanger membrane since the hydrogen is preferentially liberated on the front side of the electrode. The resistance of the electrolyte increases and the cell voltage and energy consumed become uneconomically high.

A simple process for the production of a porous foil-like gas electrode based on Raney nickel is described in German Offenlegungsschrift No. 3,342,969. However, the "gas bubble effect", that is to say the formation of a gas cushion between the electrode and membrane, also occurs in alkali metal chloride electrolysis with such an electrode.

There was, therefore, the object of developing a process for the electrolysis of alkali metal chloride solutions in which the formation of the gas cushion between the cathode and membrane is eliminated as far as possible. In particular, this process should be suitable when porous foil-like Raney nickel cathodes are used.

A process has now been found for electrolyzing aqueous alkali metal chloride solutions in a membrane cell which contains an anode chamber with the anode and a cathode chamber with the cathode, the two chambers being separated from one another by a cation exchanger membrane, in which the cathode is porous and foil-like, the cathode and cation exchanger membrane form the actual cathode chamber filled with catholyte, the cathode and cell wall form a gas space, water is fed into the cathode chamber and alkali metal hydroxide solution is withdrawn from it, hydrogen is withdrawn from the cathode chamber and gas space, aqueous alkali metal chloride solution is fed into the anode chamber and gaseous chlorine, together with depleted alkali metal chloride solution, is withdrawn from it, and a direct voltage which is at least the same as the decomposition voltage is applied to the cathode and anode. The process comprises establishing a higher pressure in the cathode chamber than in the gas space.

An electrolytic process for the preparation of sodium hydroxide solution using a cation exchanger membrane and a foil-like cathode is already known from German Offenegungsschrift No. 3,332,566. In this process, however, the cathode is operated as an oxygen diffusion cathode, so that no hydrogen is obtained.

An advantage of the process according to the invention is that most of the hydrogen produced during the electrolysis is transported through the cathode to its reverse side and can be disposed of there in a simple manner. Separation of the hydrogen from the alkali produced is thus already effected in the electrolysis cell.

The "gas bubble effect" is considerably reduced in this manner and the electrolysis can be carried out with a low cell voltage. The gas space has a device (in practice usually a tube connection) for removing hydrogen and any condensed water.

The higher the current density of the process according to the invention at the cathode, the higher the tendency for a gas cushion to develop. Current densities of at least 500 $A/m^2$, in particular at least 1,000 $A/m^2$, are preferred. An appropriate upper limit for the current density used is not more than 8,000 $A/m^2$, preferably not more than 6,000 $A/m^2$ and in particular not more than 4,000 $A/m^2$. In the process according to the invention, no oxygen or gas containing oxygen should be introduced into the gas space of the cell.

Raney nickel electrodes, in particular those which consist of a nickel network covered at least on one side with a compressed mixture of Raney nickel and polytetrafluoroethylene, have particularly favorable properties as the cathode in the process according to the invention. On the gas side, this Raney nickel electrode can also be coated with a film of polytetrafluoroethylene. Such electrodes are described in German Offenlegungsschrift No. 3,342,969, which is incorporated by reference.

The pressure difference between the catholyte chamber and gas space is about 10 mbar to 0.5 bar, in particular 20 mbar to 0.2 bar (1 mbar=1 hPa).

Since an alkali pressure gradient builds up in a vertical cell, it is advantageous to operate the process in a cell in which the cathode, anode and membrane are arranged horizontally, so that the anode covered by the anolyte lies above the membrane and the cathode covered by the catholyte lies below the cation exchanger membrane and the gas space is located below the porous foil-like cathode. In this design, the same pressure prevails at any point on the cathode. This prevents alkali passing over through the cathode into the "gas space" at points with higher alkali pressures.

The figure shows a diagrammatic cross-section through an electrochemical cell for the electrolysis of aqueous alkali metal chloride solutions which is equipped with a porous foil-like cathode. The cell is divided into an anode chamber (1), a cathode chamber (2) and a gas space (3). Saturated sodium chloride solution, for example, is pumped via a feed line (4) into the anode chamber (1). Chloride ions are discharged to give elemental chlorine at the anode (5). Dimensionally stable anodes of titanium rib meshes or perforated sheets which are activated in order to keep the chlorine excess voltage low are preferably employed. The chlorine formed and the depleted brine leave the anode chamber (1) via line (6). Between the anode chamber (1) and the cathode chamber (2) is the cation exchanger membrane (7), through which sodium ions migrate into the cathode chamber (2).

Water is fed into the cell in the form of deionized water or dilute sodium hydroxide solution via feed line (9). Alkali metal hydroxide solution is formed in the cathode chamber (2) and leaves the cell via the opening (10). The cathode chamber (2) and gas space (3) are separated from one another by the porous foil-like Raney nickel cathode (8). The gas space (3) has an opening (11), through which the hydrogen produced is removed.

As can be seen in the figure, the porous foil-like cathode (8) consists of a support network (13), which is produced from, for example, nickel and at the same time serves to supply the current and distribute the current in the Raney nickel catalyst (14). The cathode can be provided with a thin porous polytetrafluoroethylene coating (15) on the side facing the gas space. This PTFE film is permeable to gas but impermeable to liquid and thus serves to separate the gas from the liquid in the cell. It is not absolutely necessary. If the electrolysis is operated without the said film, however, an increased amount of condensate in the gas space (3) is to be reckoned with.

The pressure difference between the cathode chamber (2) and the gas space is 10–5,000 cm water column (cm WC), in particular 20p14 200 cm WC (1 cm WC=0.98 hPa). In practice, the pressure is established in a simple manner by providing the line (10) with a flow-restrictor valve (12) or extending the line (10) upwards to an overflow such that a defined column of alkali is formed. The gas space is usually operated under atmospheric pressure, that is to say without an increased pressure.

Under the conditions described, more than 90% of the hydrogen formed escape via the gas space.

The invention is illustrated below in more detail with the aid of the figure and the examples.

EXAMPLE 1

A 40 $cm^2$ membrane electrolysis cell equipped with an activated titanium anode and a cation exchanger membrane from DU PONT of the Nafion ® NX 90209 type was operated with a Raney nickel electrode without a PTFE film on the gas space side according to German Offenlegungsschrift No. 3,342,969 (area 40 $cm^2$) such that the cathode separated a 3 mm deep cathode chamber from a 10 mm deep gas space. The operating conditions of the electrolysis were 80° C., 3 $kA/m^2$, feed brine concentration of 300 g/l, anolyte concentration of 200 g/l and alkali concentration of 33% by weight. The increased pressure of the catholyte was 25–30 mbar (=25–30 hPa), and that of the gas space was 0 mbar, based on the atmosphere. Under these conditions, 99% of the hydrogen produced came from the gas space and only 1% from the cathode chamber. The cell voltage under the conditions described was 3.12 V.

EXAMPLE 2

The electrolysis was carried out under the same conditions with the same electrodes and the same cation exchanger membrane as in Example 1, but the gas space was flooded with sodium hydroxide solution. Merely the pressure difference between the cathode chamber and gas space was left at 25–30 cm WC (increased pressure in the cathode chamber). 98% of the gas came from the gas space and 2% from the cathode chamber. At a current density of 3 $kA/m^2$, the cell voltage was 3.15 V.

EXAMPLE 3

A 450 $cm^2$ membrane electrolysis cell with an activated titanium anode and a cation exchanger membrane of the Nafion (R)NX 90209 type was equipped with a Raney nickel cathode with PTFE film on the gas space side according to German Offenlegungsschrift No. 3,342,696. The cathode was 9 cm wide and 50 cm long. The electrolysis cell was operated horizontally, so that the anode lay above and the cathode below the cation exchanger membrane. The distance between the cathode and the membrane was about 4 mm here. A coarse-mesh polypropylene network was located in the cathode chamber as a spacer. The sodium hydroxide solution flowed through the cathode chamber in the longitudinal direction. At an operating temperature of 80° C. and a current density of 3 $kA/m^2$, the brine in the cell was depleted from 300 g/l to about 220 g/l, and 33% strength by weight sodium hydroxide solution was produced. Under an increased pressure in the cathode chamber of 150 cm WC, 92% of the hydrogen formed left the cell via the gas space; no production of sodium hydroxide solution in the gas space was observed. Under the conditions stated, the cell voltage was 3.20 V.

COMPARATIVE EXAMPLE

The electrolysis was carried out in a 40 $cm^2$ cell under the same conditions as in Example 1, but pressure compensation prevailed between the cathode chamber and gas space. More than 90% of the hydrogen was formed in the cathode chamber and the cell voltage rose rapidly to values above 3.40 V.

We claim:

1. A process for electrolyzing an aqueous alkali metal chloride solution in a membrane cell which contains an anode chamber with the anode and a cathode chamber with the cathode, the two chambers being separated from one another by a cation exchanger membrane, in which the cathode is porous and foil-like, the cathode and cation exchanger membrane form the actual cathode chamber filled with catholyte, the cathode and cell wall form a gas space, water is fed into the cathode chamber and alkali metal hydroxide solution is withdrawn from the cathode chamber, hydrogen is withdrawn from the cathode chamber and gas space, aqueous alkali metal chloride solution is fed into the anode chamber and gaseous chlorine, together with depleted alkali metal chloride solution, is withdrawn from the anode chamber, and a direct voltage which is at least the same as the decomposition voltage is applied to the cathode and anode, which comprises establishing a higher pressure in the cathode chamber than in the gas space during the electrolytic process, and wherein the pressure in the catholyte chamber is 10 mbar to 0.5 bar higher than in the gas space, and no oxygen is supplied to the cathods.

2. The process as claimed in claim 1, wherein the porous foil-like cathode is a Raney nickel electrode which consists of a nickel network covered at least on one side with a compressed mixture of Raney nickel and polytetrafluoroethylene.

3. The process as claimed in claim 2, wherein the Raney nickel electrode is coated with a polytetrafluoroethylene film on the gas space side.

4. The process as claimed in claim 1, wherein the pressure in the cathoyte chamber is 20 mbar to 0.2 bar higher than in the gas space.

5. The process as claimed in claim 1, wherein the electrolysis cell is operated horizontally, so that the anode covered by the anolyte lies above the membrane, the cathode covered by the catholyte lies below the cation exchanger membrane and the gas space lies below the porous foil-like cathode.

6. The process as claimed in claim 1, wherein the cell is operated with a current density of at least 500 $A/m^2$ (based on the cathode area).

* * * * *